US012059079B1

(12) United States Patent
Chen

(10) Patent No.: US 12,059,079 B1
(45) Date of Patent: Aug. 13, 2024

(54) FOLDING SEAT SUPPORT FRAME

(71) Applicant: Sheng Chen, Ningbo (CN)

(72) Inventor: Sheng Chen, Ningbo (CN)

( * ) Notice: Subject to any disclaimer, the term of this patent is extended or adjusted under 35 U.S.C. 154(b) by 0 days.

(21) Appl. No.: 18/380,697

(22) Filed: Oct. 17, 2023

Related U.S. Application Data

(63) Continuation of application No. 18/211,301, filed on Jun. 19, 2023, now Pat. No. 11,786,041.

(51) Int. Cl.
*A47C 9/10* (2006.01)
*A47C 4/28* (2006.01)

(52) U.S. Cl.
CPC ..... *A47C 9/105* (2013.01); *A47C 4/286* (2013.01)

(58) Field of Classification Search
CPC ..... A47C 9/105; A47C 4/286
See application file for complete search history.

(56) References Cited

U.S. PATENT DOCUMENTS 10,010,179 B1 * 7/2018 Stump ..... A47C 4/44
2002/0117878 A1 * 8/2002 Fox ..... A47C 4/286 297/16.2
2011/0156449 A1 * 6/2011 Obolewicz ..... A47C 4/286 297/16.2
2011/0254325 A1 * 10/2011 Obolewicz ..... A47C 4/286 297/16.2

FOREIGN PATENT DOCUMENTS

KR 1590505 B1 * 2/2016 ..... A47C 4/00

* cited by examiner

*Primary Examiner* — Anthony D Barfield
(74) *Attorney, Agent, or Firm* — Jose Cherson Weissbrot

(57) ABSTRACT

A folding seat support frame includes an upper support frame detachably connected to a seat fabric and a lower support frame connected to the upper support frame, where the upper support frame includes an upper connector, short rods rotationally connected to the upper connector at a first limited angle, and upper connecting rods rotationally connected to the short rods at a second limited angle; the lower support frame includes a lower connector and lower connecting rods rotationally connected to the lower connector at a third limited angle; the lower connector and the upper connector are coaxially and rotationally connected; when the folding seat support frame is in an unfolded state, the lower connecting rods and the short rods are oriented to a side of the lower connector; when the folding seat support frame is in a folded state, the short rods are butted against the lower connector.

17 Claims, 5 Drawing Sheets

FOLDING SEAT SUPPORT FRAME

CROSS-REFERENCES OF THE RELATED APPLICATIONS

This application is a continuation-in-part (CIP) application of U.S. application Ser. No. 18/211,301 filed on Jun. 19, 2023, now U.S. Pat. No. 11,786,041 the entire-contents of which are incorporated herein by reference.

TECHNICAL FIELD

The present disclosure relates to a folding seat support frame.

BACKGROUND

Folding chairs, which are easy to store and carry, are widely used in leisure places, such as outdoor camping sites or courtyards. Most of the existing folding chairs are hinged with multiple sets of connecting rods. When they are folded, they usually have a large seat area and a folding size, and thus still require a large storage space. In view of this, the existing folding chair needs to be further improved.

SUMMARY

A technical problem to be solved by the present disclosure is that the folding chair in the prior art increases both the seat area and folding size and has poor use stability.

In order to solve the above-mentioned technical problem, the present disclosure adopts the following technical solution.

A folding seat support frame includes an upper support frame detachably connected to a seat fabric and a lower support frame connected to the upper support frame, where the upper support frame includes an upper connector, short rods rotationally connected to the upper connector at a limited angle, and upper connecting rods rotationally connected to the short rods at a limited angle;

the lower support frame includes a lower connector and lower connecting rods rotationally connected to the lower connector at a limited angle; and the lower connector and the upper connector are coaxially and rotationally connected;

when the folding seat support frame is in an unfolded state, the lower connecting rods and the short rods are oriented to a side of the lower connector; free ends of the upper connecting rods are located at a same side of the upper connector; and free ends of the lower connecting rods are located at a same side of the lower connector; and when the folding seat support frame is in a folded state, the free ends of the upper connecting rods and the free ends of the lower connecting rods are located at a same side of the lower connector; the short rods are butted against the lower connector; and ends of the short rods connected to the upper connecting rods are located below a top of the upper connector.

Optionally, the upper connector is provided with a first limiting portion; an end of the upper connecting rod connected to the short rod is provided with a second limiting portion; when the folding seat support frame is switched from the folded state to the unfolded state, the short rod is butted in place against the first limiting portion; and the upper connecting rod is butted in place against the short rod through the second limiting portion.

Optionally, the lower connecting rod is rotationally connected to the lower connector through a rotating connector at a limited angle.

Optionally, the upper connector is fixedly connected to an upper end of a central shaft; the central shaft passes through the lower connector, and is externally sleeved with a sleeve; and the sleeve is movable up and down in an axial direction of the central shaft.

Optionally, the sleeve is provided with grooves; and a head of the rotating connector is provided with protruding teeth that are matched with the grooves.

Optionally, a lower end of the central shaft is provided with a positioning element; and the positioning element is detachably connected to the sleeve.

Optionally, the lower connector includes a connecting body; the connecting body is provided with three or more lower connecting positions; and a space is provided between any adjacent pair of the lower connecting positions.

Optionally, the space is configured to accommodate or roughly accommodate at least one of the short rods.

Optionally, the short rod is rotatable around a first connecting shaft relative to the upper connector; and a vertical distance from a center of the first connecting shaft to an axis of the upper connector is greater than or equal to a vertical distance from a lowest point of the space to the axis.

Optionally, the short rod is rotatable by a maximum angle less than 90 degrees around a first connecting shaft relative to the upper connector; and the upper connecting rod is rotatable by a maximum angle greater than 90 degrees around a second connecting shaft relative to the short rod.

Preferably, the upper connecting rods are telescopic rods.

Optionally, when the folding seat support frame is in the unfolded state, the upper connecting rods and the lower connecting rods are located at upper and lower sides of the connecting body, respectively; and when the folding seat support frame is in the folded state, the free ends of the upper connecting rods and the free ends of the lower connecting rods are located below the connecting body.

A folding seat support frame includes a connecting body and a connector that are connected to each other, where the connecting body includes upper connecting positions and lower connecting positions; the connector includes short rods, upper connecting rods, and lower connecting rods; the upper connecting positions are connected to the upper connecting rods respectively through the short rods; the lower connecting positions are connected to the lower connecting rods, respectively; a space configured to accommodate at least one of the short rods is provided between each adjacent pair of the lower connecting positions; when the folding seat support frame is in a folded state, the upper connecting rods and the lower connecting rods are located at a same side of the connecting body, the short rod is located in the space, and an end of the short rod connected to the upper connecting rod is located below a top of the connecting body.

Optionally, each of the upper connecting positions is provided with a first limiting portion; and an end of the upper connecting rod connected to the short rod is provided with a second limiting portion; and when the folding seat support frame is in an unfolded state, the short rod is butted against the first limiting portion; the upper connecting rod is butted against the short rod through the second limiting portion; free ends of the upper connecting rods and free ends of the lower connecting rods are located at upper and lower sides of the connecting body, respectively; an orientation of the upper connecting rods is opposite to an orientation of the lower connecting rods; and an orientation of the short rods is the same as the orientation of the lower connecting rods.

Optionally, the upper connecting positions and the lower connecting positions are evenly and alternatively distributed along a circumference of the connecting body; and the connector is detachably connected to the connecting body.

Optionally, the space is configured to adaptively accommodate the short rod; when the folding seat support frame is in a folded state, the short rod is located in the space and spaced apart from the lower connecting rod, and the upper connecting rod and the lower connecting rod located at the same side of the connecting body are spaced apart from each other; and a maximum radial cross-sectional area of the connecting body is greater than or equal to a cross-sectional area of the folding seat support frame with a minimum volume in the folded state.

A folding seat support frame includes a connecting body and a connector that are connected to each other, where the connecting body includes upper connecting positions and lower connecting positions; the connector includes short rods, upper connecting rods, and lower connecting rods; the upper connecting positions are connected to the upper connecting rods respectively through the short rods; the lower connecting positions are connected to the lower connecting rods, respectively; and when the folding seat support frame is in an unfolded state, the upper connecting rods and the lower connecting rods are oriented in opposite directions, and are located at upper and lower sides of the connecting body, respectively; and when the folding seat support frame is in a folded state, a free end of an upper connector and a free end of a lower connector are located below the connecting body; the short rods are butted against the connecting body; and ends of the short rods connected to the upper connecting rods are located below a top of the connecting body.

Optionally, each of the upper connecting positions is provided with a first limiting portion; and an end of the upper connecting rod connected to the short rod is provided with a second limiting portion; and when the folding seat support frame is in the unfolded state, the short rod is butted against the first limiting portion; the upper connecting rod is butted against the short rod through the second limiting portion; free ends of the upper connecting rods and free ends of the lower connecting rods are located at upper and lower sides of the connecting body, respectively; an orientation of the upper connecting rods is opposite to an orientation of the lower connecting rods; and an orientation of the short rods is the same as the orientation of the lower connecting rods.

Optionally, the upper connecting positions and the lower connecting positions are evenly and alternatively distributed along a circumference of the connecting body; and the connector is detachably connected to the connecting body.

Optionally, a space is provided between each adjacent pair of the lower connecting positions; the space is configured to adaptively accommodate the short rod; when the folding seat support frame is in a folded state, the short rod is located in the space and spaced apart from the lower connecting rod, and the upper connecting rod and the lower connecting rod located at the same side of the connecting body are spaced apart from each other; and a maximum radial cross-sectional area of the connecting body is greater than or equal to a cross-sectional area of the folding seat support frame with a minimum volume in the folded state.

Optionally, when the folding seat support frame is switched from the folded state to the unfolded state, the short rod is rotated at an angle less than 90 degrees; and the upper connecting rod is rotated at an angle greater than 90 degrees.

Compared with the prior art, the present disclosure has the following advantages. The present disclosure overcomes the limitation that the upper support frame of the folding seat can only be folded above the folding seat. In the present disclosure, the upper connecting rods and the short rods of the folding seat support frame are rotated downward for storage, which greatly reduces the space occupied after folding. The upper connecting rods and the short rods of the folding seat support frame are rotated upward to an unfolded state. The lower connecting rods and the short rods are oriented to one side of the lower connector. The free ends of the upper connecting rods are at a same side of the upper connector, and the free ends of the lower connecting rods are at a same side of the lower connector. The short rod further expands the distance between the upper connecting rods, thereby increasing the seat area without changing the folding size, or maximizing the seat area without changing the folding size. In addition, the lower support frame disperses the pressure through multiple points, and the sleeve with a simple and reliable structure cooperates with the lower connecting rod to achieve synchronous movement, improving the stability of the folding seat during use.

REFERENCE NUMERALS

Figure 1:
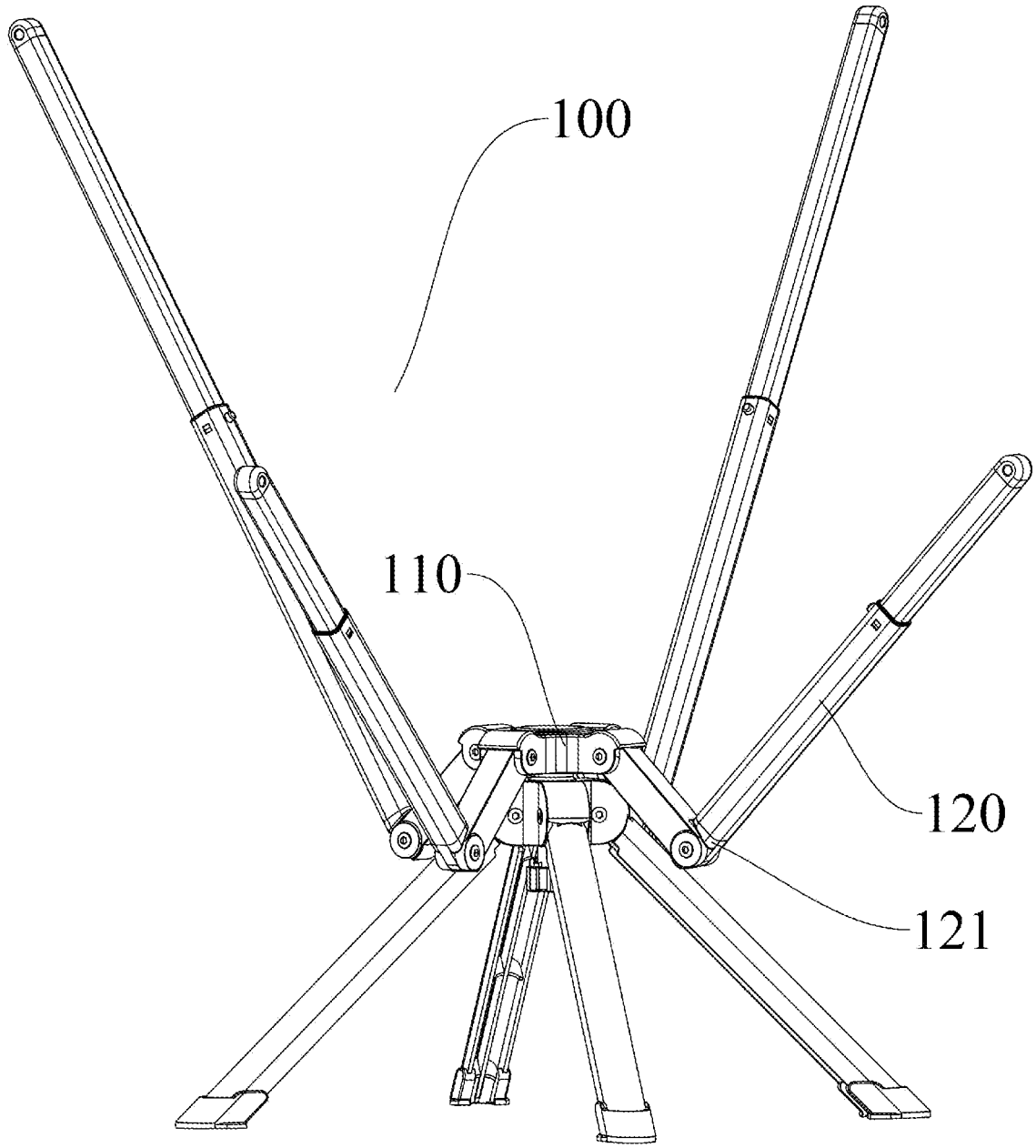
FIG. 1 is an overall structural diagram of a folding seat support frame according to the present disclosure.
Figure 2:
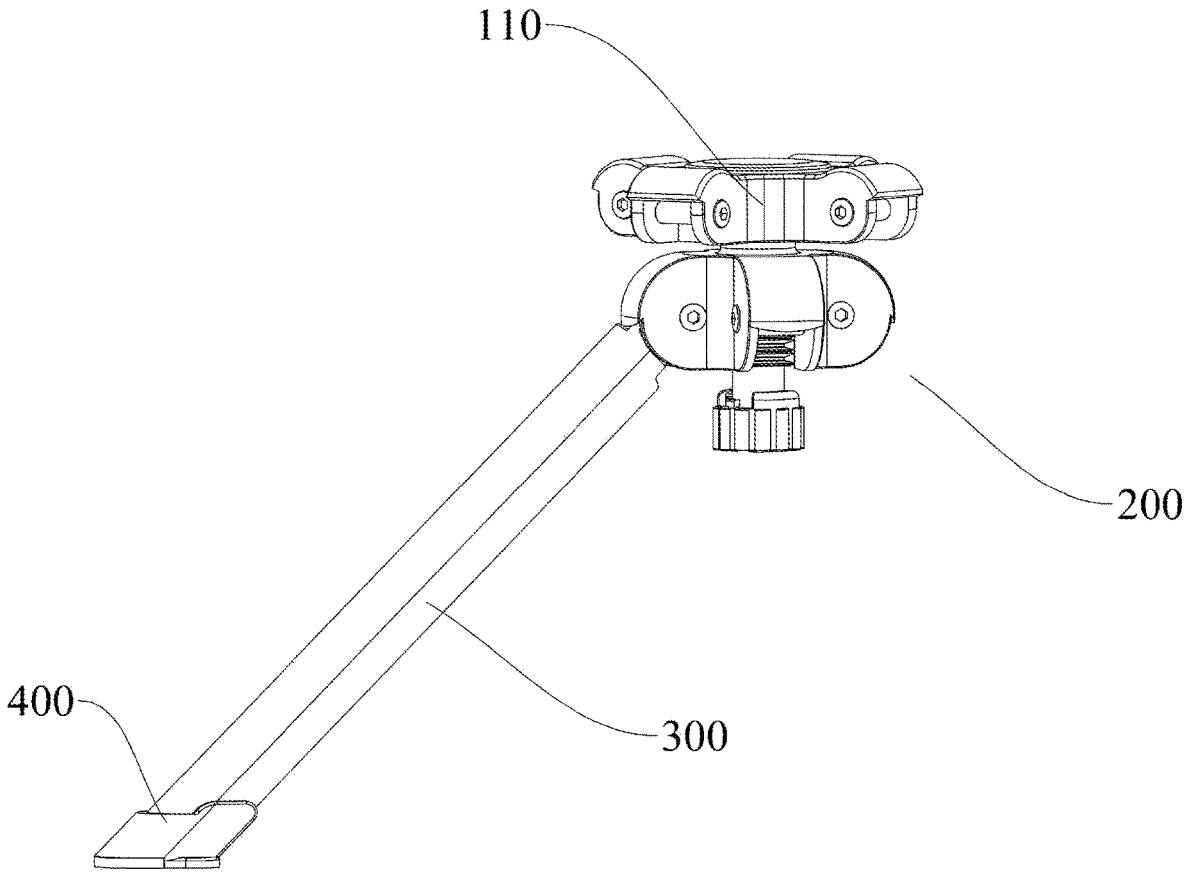
FIG. 2 is a partial structural diagram of the folding seat support frame according to the present disclosure.

100. upper support frame; 110. upper connector; 111. upper connecting position; 112. first limiting portion; 120. upper connecting rod; 121. second limiting portion; 122. first connecting shaft; 123. side; and 130. short rod;

200. lower connector; 201. fixing element; 202. limit washer; 203. bearing; 210. connecting body; 211. lower connecting position; 212. third limiting portion; 213. butting surface; 214. space; 215. connecting portion; 220. sleeve; 221. groove; 222. curved surface; 230. central shaft; 231. limiting portion; 232. positioning element; 240. rotating connector; 241. protruding tooth; 242. rotating shaft; and 243. pivoting portion;

300. lower connecting rod; and

400. foot pad.

DETAILED DESCRIPTION OF THE EMBODIMENTS

The present disclosure will be described in further detail below with reference to the accompanying drawings and examples.

In this specification, unless otherwise specified, the term "axial" refers to a vertical direction of a main body of a folding support frame during use, the term "radial" refers to a direction perpendicular to the "axial" direction, and the term "circumferential" refers to a circumferential direction around which a maximum diameter of the main body is located.

In this specification, the term "connector" refers to an upper and/or lower connector, the term "connecting position" refers to an upper and/or lower connecting position, the term "supporting element" refers to an upper and/or lower supporting element, and the term "supporting rod" refers to an upper and/or lower supporting rod.

In this specification, the term "folded state" indicates that the supporting rod is in an idle state, not supporting a corresponding device's use surface, nor being supported on the ground, and the term "unfolded state" indicates that the supporting rod is unfolded in place, stably supporting the corresponding device's use surface (upwards) or stably supported on the ground (downwards).

Referring to FIGS. 1 to 5, the present disclosure provides a folding seat support frame, which is matched with a detachable seat fabric, and includes upper support frame 100 and a lower support frame that are rotationally connected. The upper support frame 100 is detachably connected to the seat fabric, and includes upper connector 110, short rods 130 rotationally connected to the upper connector 110 at a first limited angle, and upper connecting rods 120 rotationally connected to the short rods 130 at a second limited angle. The lower support frame includes lower connector 200, lower connecting rods 300 rotationally connected to the lower connector 200 at a third limited angle, and foot pads 400 respectively located at ends of the lower connecting rods 300. The first limited angle, the second limited angle, and the third limited angle refer to angles that the short rod 130, the upper connecting rod 130, and the lower connecting rod 300 are rotated from a storage state to a fully unfolded use state. The first limited angle and the third limited angle are less than 90 degrees, and the second limited angle is greater than 90 degrees.

The lower connector 200 and the upper connector 110 are coaxially and rotationally connected. In an embodiment, the upper connector 110 includes bearing 203. The bearing 203 is located inside the upper connector 110. Central shaft 230 passes through the lower connector 200. An upper end of the central shaft 230 is fixedly connected to the upper connector 110. The upper connector 110 is rotationally connected to the lower connector 200 around the central shaft 230 through the bearing 203. In an embodiment, an upper end of the central shaft 230 is fixedly connected to the upper connector 110 through fixing element 201. In an embodiment, the fixing element 201 is a screw. In an embodiment, the bearing 203 is retained inside the upper connector 110 through limit washer 202. An outer surface of the bearing 203 is in contact with an inner wall of the upper connector 110. An inner surface of bearing 203 is in contact with an outer wall of the connecting portion 215 of the lower connector 200.

The central shaft 230 is provided with limiting portion 231 that is matched with a step surface located inside the lower connector 200 and is configured to fixedly connect the lower connector 200 to the bearing 203. A portion of an outer wall of the lower connector 200 is in contact with an inner surface of the bearing 203. In other embodiments, the upper connector 110 may also be rotationally connected to the lower connector 200 through another common rotational connection manner other than the bearing.

A first end of the short rod 130 is provided with a first connecting hole. The upper connector 110 is provided with upper connecting positions 111. The short rod 130 is rotationally connected to the upper connecting position 111 through first connecting shaft 122 located in the first connecting hole. In an embodiment, a first end of the upper connecting rod 120 is provided with an outer edge of arc transition to achieve unobstructed rotation of the upper connecting rod 120. In some implementation cases, the upper connecting rod 120 may be in a concave-convex fit, such that the upper connecting rod 120 is rotated in a fitted manner.

In an embodiment, each upper connecting position 111 of the upper connector 110 is provided with first limiting portion 112. The short rod 130 is provided with side 123. One end of the upper connecting rod 120 connected to the short rod 130 is provided with second limiting portion 121. When the folding seat support frame is switched from a folded state to an unfolded state, a first position of the side 123 of the short rod 130 is butted in place against the first limiting portion 112. An end of the upper connecting rod 120 is butted in place against a second position of the side 123 of the short rod 130 through the second limiting portion 121. When the folding seat support frame is in a stable state after being unfolded, the first position of the side 123 maintains contact with the first limiting portion 112. The second position of the side 123 maintains contact with an end surface of the second limiting portion 121. The end surface of the second limiting portion 121 is inclined. When it is necessary to fold and store the folding seat support frame, the short rod 130 is rotated downward around the first connecting shaft 122 until it enters a space between an adjacent pair of the lower connecting positions 211 of the lower connector 200. The upper connecting rod 120 is rotated downwards around a rotating shaft rotationally connected to the short rod 130, until free ends of all the upper connecting rods 120 are located at a same side of the lower connector 200. The movement of the short rod 130 and the movement of the upper connecting rod 120 can be carried out simultaneously or in steps, not limited to any sequential order. In an embodiment, the upper connecting rod 120 is rotated downwards to contact with the lower connecting rod 300.

The lower connector 200 includes connecting body 210. The connecting body 210 is provided with three or more lower connecting positions 211. The lower connecting positions 211 are configured to achieve a limited rotational connection with the lower connecting rod 300. In an embodiment, the lower connecting rod 300 is rotationally connected to the lower connecting position 211 through rotating connector 240 at a third limited angle. The lower connecting positions 211 are evenly arranged in a circumferential direction of the connecting body 210. In an embodiment, space 214 between each adjacent pair of lower connecting positions 211 is configured to accommodate or roughly accommodate at least one short rod 130. The capacity of the space 214 is a factor that determines the storage space of the folding seat. In an embodiment, the number of the upper connecting positions 111 is the same as the number of the lower connecting positions 211. In other embodiments, the number of the upper connecting positions 111 is different from the number of the lower connecting positions 211.

In an embodiment, the upper connecting rod 120 and the lower connector 200 are located at a same side of the connecting body 210 when the folding seat support frame is in a folded state. Further, when the folding seat support frame is in an unfolded state, the lower connecting rod 300 and the short rod 130 are oriented to a side of the lower connector 200. The free ends of the upper connecting rods 120 are located at a same side of the upper connector 110, and free ends of the lower connecting rods 200 are located at a same side of the lower connector 110. The orientation of the upper connecting rod 120 is opposite to that of the lower connecting rod 300. The upper connecting position 111 and the lower connecting position 211 are evenly and alternatively distributed along a circumference of the connecting body 210. The connector and the connecting body 210 are detachably connected.

When the folding seat support frame is in an unfolded state, the free ends of the upper connecting rod 120 and the lower connecting rod 300 are respectively located at upper and lower sides of the connecting body 210, and the orientation of the upper connecting rod 120 is opposite to that of the lower connecting rod 300. When the folding seat support frame is in a folded state, the free ends of the upper connecting rods 120 and the free ends of the lower connecting rods 300 are located below the connecting body 210. The short rods 130 is butted against the lower connector 200, and ends of the short rods 130 connected to the upper connecting rod 120 are located below a top of the upper connector 110. In an embodiment, a vertical distance from a center of the first connecting shaft 122 to an axis of the upper connector 110 is greater than or equal to a vertical distance from a lowest point of the space 214 to the axis. The lowest point of the space 214 refers to a point located on an outer surface of the space 214 and with a shortest vertical distance to the axis. In this way, the short rod 130 and the upper connecting rod 120 can be folded parallel to or at a compact angle with the lower connecting rod 300. For example, when all adjacent foot pads 400 come into contact, all lower connecting rods 300 are folded in a contact position. After the short rod 130 is stored within the space 214, a tail end of the upper connecting rod 120 is roughly folded on an axis of the upper connector 110 where the contact position is located.

The short rod 130 is rotated at an angle less than 90 degrees when the folding seat support frame is switched from a storage state (folded state) to a fully unfolded use state (unfolded state). When the folding seat support frame is switched from the storage state to the fully unfolded use state, the upper connecting rod 120 is rotated at an angle greater than 90 degrees, or greater than 180 degrees in extreme cases. When the rotation angle is obtuse, the overall stability of the upper support frame is desired. In the storage state of the short rod 130, the short rod 130 enters the space 214 and is basically parallel to the lower connecting rod 200 (not shown in the figure). In the storage state of the upper connecting rod 120, the upper connecting rod 120 is rotated downwards to contact the lower connecting rod 300 or the foot pad 400. At this point, the upper connecting rod 120 is folded parallel to the lower connecting rod 300 or at a compact angle with the lower connecting rod 300. As shown in FIG. 1, when the upper connecting rod 120 and the short rod 130 are in a fully unfolded use state, they can support the seat fabric for a user to sit or lie down. In some embodiments, the upper connecting rod 120 may be a multi-segment telescopic rod, which can form the upper support frame 100 in different shapes. When the upper connecting rod 120 is retracted to be shortest, it is not necessary to remove the seat fabric from the upper support frame 100, but to wrap the seat fabric directly downwards around the folding seat support frame. When the folding seat is matched with an elastic or extensible seat fabric, the storage effect is better. For a seat fabric made of other flexible material that does not have elasticity or ductility, it can also be wrapped downwards for storage, or disassembled for separate storage.

The lower connecting position 211 is provided with a limited space for an end of the rotating connector 240 to rotate within. In an embodiment, the lower connecting position 211 includes third limiting portion 212 for determining a maximum rotation angle of the rotating connector 240 and limiting the rotating connector 240 to a position of the maximum rotation angle. In an embodiment, the third limiting portion 212 is provided with butting surface 213. The butting surface 213 forms surface contact with a portion of an outer wall of the lower connecting rod 300 so as to evenly distribute a pressure. In another embodiment, the butting surface 213 forms surface contact with a portion of an outer wall of pivoting portion 243 of the rotating connector 240, and the outer wall of the lower connecting rod 300 does not contact or directly contact the butting 1I surface 213. Whether the outer wall of the lower connecting rod 300 is in direct contact with the butting surface 213 depends on the manner of connection between the lower connecting rod 300 and the rotating connector 240 or the pivoting portion 243.

In an embodiment, the central shaft 230 is externally sleeved with sleeve 220. The sleeve 220 is movable up and down along an axial direction of the central shaft 230. A lower end of the central shaft 230 is provided with positioning element 232. The positioning element 232 and the limiting portion 231 jointly determine a maximum displacement of the sleeve 220 in the axial direction of the central shaft 230. When the sleeve 220 is stably connected to the positioning element 232, the rotating connector 240 is opened to a maximum rotation angle. When the rotating connector 240 is rotated until the lower support frame is fully folded to a minimum volume, the sleeve 220 is far away from the positioning element 232 and close to the limiting portion 231, or is butted against the limiting portion 231. In an embodiment, the positioning element 232 is a nut with an internal thread, and a lower portion of the sleeve 220 is provided with an external thread that is matched with the internal thread. In other embodiments, the positioning element 232 can also be connected to the lower portion of the sleeve 220 through clamping or other detachable connection manner, such as using an elastic buckle.

In an embodiment, the sleeve 220 is provided with grooves 221. In an embodiment, the grooves are continuously distributed in a circumferential direction of the sleeve 220 to form continuous or approximately circular grooves. In an embodiment, curved surface 222 is provided between sides of each adjacent pair of grooves 221 in the circumferential direction to form an arc transition, in order to reduce a resistance during the mounting of the sleeve 220 or when the sleeve 220 is rotated within the connecting body 210. A head of the rotating connector 240 is provided with protruding teeth 241 that are matched with the grooves 221. When the rotating connector 240 is rotated around the rotating shaft 242 in the lower connecting position 211, the protruding teeth 241 are sequentially inserted into and detached from the grooves 221 to drive the sleeve 220 to move up and down along the axial direction. When the protruding teeth 241 move relative to the grooves 221, at least one of the protruding teeth 241 is held inside the groove 221.

Figure 3:
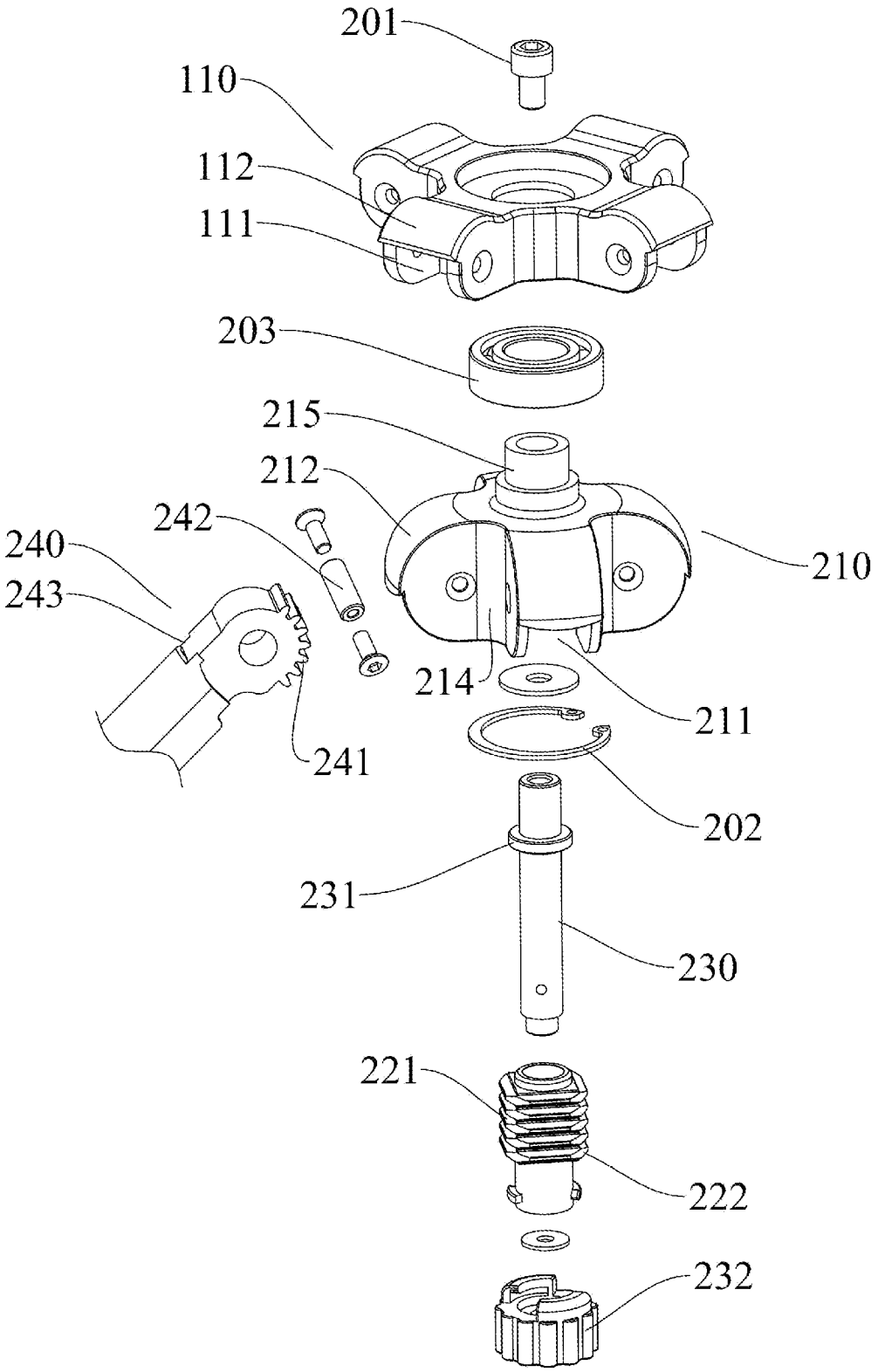
FIG. 3 is a partial exploded view of the folding seat support frame according to the present disclosure.
Figure 4:
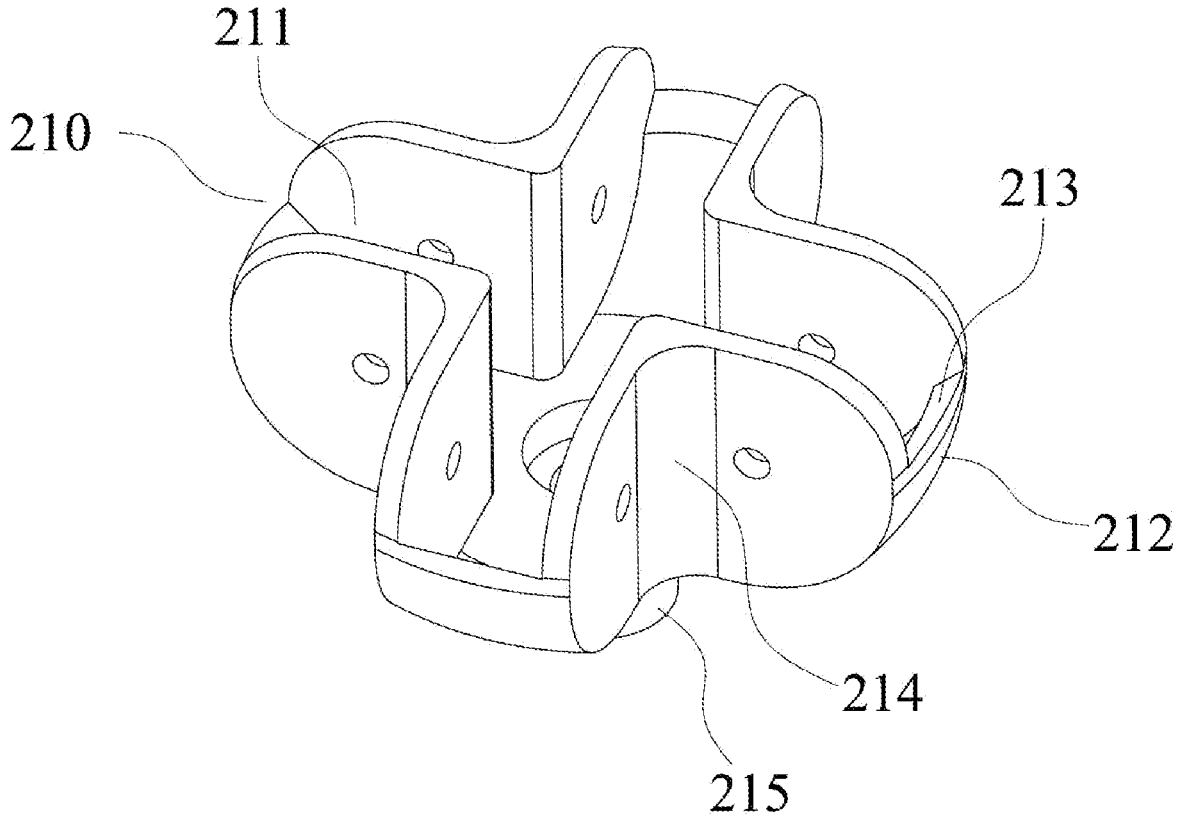
FIG. 4 is a structural diagram of a connecting body of the folding seat support frame according to the present disclosure.
Figure 5:
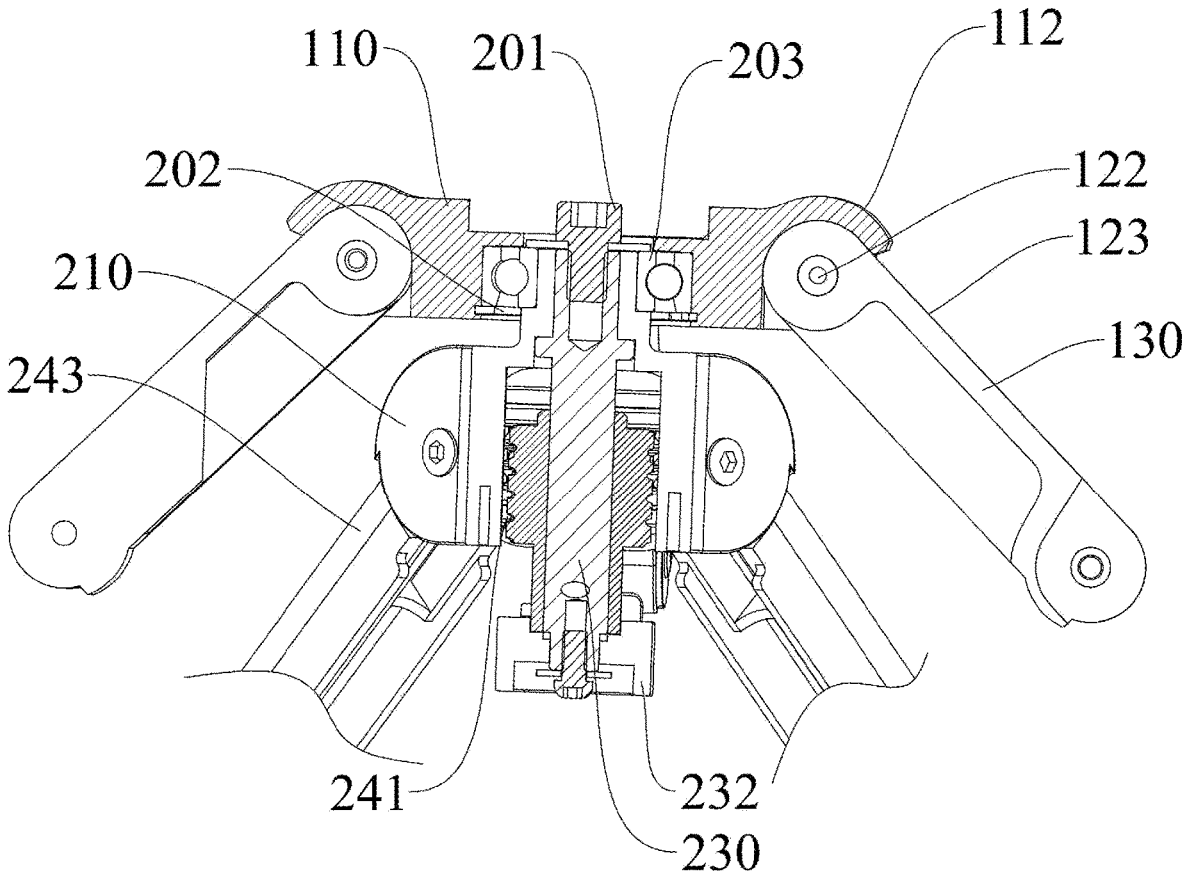
FIG. 5 is a partial sectional view of the folding seat support frame according to the present disclosure.

In an embodiment, a cross section of an outer surface of the sleeve 220 is a regular polygon, and a number of sides of the regular polygon is equal to a number of the lower connecting positions 211. As shown in FIG. 3, the cross section of the sleeve 220 is a square, corresponding to four lower connecting positions 211. In other embodiments, the cross section of the sleeve 220 may also be an equilateral triangle, an equilateral pentagon, an equilateral hexagon, an equilateral octagon, etc.

The sleeve 220 is matched with the rotating connector 240, allowing multiple lower connecting rods to rotate synchronously, thereby enhancing the overall stability of the lower support frame during use.

What is claimed is:

1. A folding seat support frame, comprises:

an upper support frame detachably connected to a chair surface, and a lower support frame connected to the upper support frame; and wherein, said upper support frame includes an upper connector, a short rod rotatably attached to said upper connector, and an upper connecting rod rotatably attached to said short rod; and wherein, said lower support frame includes a lower connector, a lower connecting rod rotatably attached to said lower connector; and wherein, said lower connector is coaxially and rotatably connected to said upper connector; and said lower connector includes a connecting body, and said connecting body has at least three lower connecting positions, wherein any two adjacent lower connecting positions have a space between them; and wherein, when said folding seat support frame transitions from a folded state to an unfolded state, the free end of said upper connecting rod moves away from said upper connector, and the free end of said lower connecting rod moves away from said lower connector; and wherein, when said folding seat support frame is in said unfolded state, said upper connecting rod and said lower connecting rod are respectively located on the upper and lower sides of said connecting body; when said folding seat support frame is in said folded state, the free ends of said upper connecting rod and said lower connecting rod are located below said connecting body.

2. The folding seat support frame according to claim 1, wherein, when said folding seat support frame is in said unfolded state, the free ends of said lower connecting rods and said short rods are located on the same side of said lower connection component, while the free end of said upper connecting rod is located on the same side of said upper connector; and when said folding seat support frame is in said folded state, the free ends of said upper connecting rod and said lower connecting rod are located on the same side of said lower connection component, and said short rod abuts against said lower connection component, and one end of the short rod connected to the upper connecting rod is located below the top of the upper connector.

3. The folding seat support frame according to claim 2, wherein, said upper connector has a first limiting portion, and one end of said upper connecting rod connected to said short rod has a second limiting portion, when said folding seat support frame transitions from said folded state to said unfolded state, said short rod abuts against said first limiting portion, and said upper connecting rod abuts against said second limiting portion.

4. The folding seat support frame according to claim 2, wherein, also comprises a rotating connector and a central shaft; and wherein, said lower connecting rod is connected to said lower connection component through said rotating connector at a limited angle; and wherein, said upper connection component is fixedly connected to an upper end of said central shaft, and said central shaft passes through said lower connection component, and a sleeve is sleeved outside said central shaft, and said sleeve can move up and down along an axial direction of said central shaft.

5. The folding seat support frame according to claim 4, wherein, said sleeve has a groove, and the head of said rotating connector has a protruding tooth that matches said groove.

6. The folding seat support frame according to claim 4, wherein, the lower end of said central shaft is provided with a positioning element, and said positioning element is detachably connected to said sleeve.

7. The folding seat support frame according to claim 1, wherein, said space can accommodate at least one short rod.

8. The folding seat support frame according to claim 1, wherein, said short rod rotates relative to said upper connector around a first connecting shaft, and the vertical distance from the center of said first connecting shaft to the axis of said upper connector is not less than the vertical distance from the lowest point of said space to the axis.

9. The folding seat support frame according to claim 1, wherein, the maximum angle of rotation of said short rod relative to said upper connector around a first connecting shaft is less than 90 degrees, and the maximum angle of rotation of said upper connecting rod relative to said short rod around the second connecting shaft is greater than 90 degrees.

10. A folding seat support frame, comprising:

a connecting body and connectors; and wherein said connecting body has a plurality of connecting positions, said connecting body and said connectors being rotatably connected through said connecting positions; and wherein said connectors comprise a short rod, an upper connecting rod and a lower connecting rod, said connecting body being connected to said upper connecting rod through said short rod; and wherein at least one space capable of accommodating one of said short rods is provided between each two adjacent said connecting positions; and wherein, spacing adaptively accommodates said short rod, when said folding seat support frame is in a folded state, said short rod is located in said space and is spaced apart from said lower connecting rod, whereby said upper connecting rod and said lower connecting rod are spaced apart from each other on the same side of said connecting body, and the maximum radial cross-sectional area of said connecting body is greater than or equal to the cross-sectional area of the minimum volume of said folding seat support frame when it is in said folded state; and wherein, when said folding seat support frame is switched from a folded state to an unfolded state, the free end of said upper connecting rod and the free end of said lower connecting rod are moved away from the connecting body.

11. The folding seat support frame according to claim 10, wherein, when said folding seat support frame is in a folded state, said upper connecting rod and said lower connecting rod are located on the same side of said connecting body, and said short rod is located in said space when said folding seat support frame is in said folded state, and one end of said short rod connected to said upper connecting rod is located below the top of said connecting body.

12. The folding seat support frame according to claim 10, wherein, said connecting positions has a first limiting portion, and one end of said upper connecting rod connected to said short rod has a second limiting portion; and when said folding seat support frame is in an unfolded state, said short rod abuts against said first limiting portion, and said upper connecting rod abuts against said short rod through said second limiting portion, and the free ends of said upper connecting rod and said lower connecting rod are located on the upper and lower sides of said connecting body, respectively, said upper connecting rod and said lower connecting rod face in opposite directions, while said short rod and said lower connecting rod face in the same direction.

13. The folding seat support frame according to claim 12, wherein, said connector are evenly staggered along the circumference of said connecting body, and said connector is detachably connected to said connecting body.

14. A folding seat support frame, comprising:

a connecting body and connectors; and wherein said connecting body has a plurality of connecting positions, said connecting body and said connectors being rotatably connected through said connecting positions; and wherein said connectors comprise a short rod, an upper connecting rod and a lower connecting rod, said connecting body being connected to said upper connecting rod through said short rod; and wherein, when said folding seat support frame is switched from a folded state to an unfolded state, the free end of said upper connecting rod and the free end of said lower connecting rod are moved away from the connecting body.

15. The folding seat support frame according to claim 14, wherein, when said folding seat support frame is in said unfolded state, the free ends of said upper connecting rod and said lower connecting rod are located on the upper and lower sides of said connecting body, respectively, and face in opposite directions; and when said folding seat support frame is in said folded state, the free ends of said upper connector and said lower connector are located below said connecting body, and one end of said short rod connected to said upper connecting rod is located below the top of said connecting body, and said short rod abuts against said connecting body.

16. The folding seat support frame according to claim 15, wherein, said connecting positions is equipped with a first limiting portion, and one end of said upper connecting rod connected to said short rod is equipped with a second limiting portion; and when said folding seat support frame is in said unfolded state, said short rod abuts against said first limiting portion, and said upper connecting rod abuts against said short rod through said second limiting portion, and the free ends of said upper connecting rod and said lower connecting rod are located on the upper and lower sides of said connecting body, respectively, and face in opposite directions, and said short rod and said lower connecting rod face in the same direction.

17. The folding seat support frame according to claim 15, wherein, each two adjacent said connecting positions have a space between them, and said space adaptively accommodates said short rod, in said folded state, said short rod is located in said space and is spaced apart from said lower connecting rod, and said upper connecting rod and said lower connecting rod are spaced apart from each other on the same side of said connecting body, the maximum radial cross-sectional area of said connecting body is greater than or equal to the cross-sectional area of the minimum volume of said folding seat support frame when it is in said folded state.

* * * * *